US010060002B2

(12) United States Patent
Mizoguchi et al.

(10) Patent No.: US 10,060,002 B2
(45) Date of Patent: Aug. 28, 2018

(54) H-SECTION STEEL AND METHOD OF PRODUCING THE SAME

(71) Applicant: NIPPON STEEL & SUMITOMO METAL CORPORATION, Tokyo (JP)

(72) Inventors: Masaki Mizoguchi, Kimitsu (JP); Kazutoshi Ichikawa, Kimitsu (JP); Kazuaki Mitsuyasu, Osaka (JP); Hirokazu Sugiyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 70 days.

(21) Appl. No.: 15/039,753

(22) PCT Filed: Dec. 5, 2014

(86) PCT No.: PCT/JP2014/082267

§ 371 (c)(1),
(2) Date: May 26, 2016

(87) PCT Pub. No.: WO2015/093321

PCT Pub. Date: Jun. 25, 2015

(65) Prior Publication Data

US 2016/0376675 A1 Dec. 29, 2016

(30) Foreign Application Priority Data

Dec. 16, 2013 (JP) ..... 2013-259410

(51) Int. Cl.
*C21D 9/04* (2006.01)
*C21D 9/00* (2006.01)
(Continued)

(52) U.S. Cl.
CPC ..... *C21D 9/0068* (2013.01); *B21B 1/088* (2013.01); *B22D 25/02* (2013.01); *C21C 7/06* (2013.01);
(Continued)

(58) Field of Classification Search
None
See application file for complete search history.

(56) References Cited

U.S. PATENT DOCUMENTS 5,421,920 A 6/1995 Yamamoto et al.
2014/0301889 A1 10/2014 Ichikawa et al.

FOREIGN PATENT DOCUMENTS

JP 4-157117 A 5/1992
JP 4-279247 A 10/1992
(Continued)

OTHER PUBLICATIONS

International Search Report for PCT/JP2014/082267 dated Mar. 10, 2015.
(Continued)

*Primary Examiner* — Adam Krupicka
(74) *Attorney, Agent, or Firm* — Birch, Stewart, Kolasch & Birch, LLP

(57) ABSTRACT

An H-section steel has a predetermined chemical composition in which Ti oxides having a grain size of 0.01 μm to 3.0 μm are included at a density of 30 pieces/mm$^2$ or more, a thickness of a flange is 100 mm to 150 mm, an area fraction of bainite at a ⅙ position from a surface of the flange in a length direction and at a ¼ position from the surface thereof in a thickness direction is 80% or more, a yield strength or 0.2% proof stress is 450 MPa or more, and a tensile strength is 550 MPa or more, a Charpy absorbed energy at 21° C. at a ½ position from the surface of the flange in the length direction and at a ¾ position from the surface thereof in the thickness direction is 100 J or more, and an average austenite grain size is 50 μm to 200 μm.

7 Claims, 2 Drawing Sheets

(51) Int. Cl.

| | |
|---|---|
| ***C21D 8/00*** | (2006.01) |
| ***C21C 7/06*** | (2006.01) |
| ***C22C 38/00*** | (2006.01) |
| ***C22C 38/14*** | (2006.01) |
| ***C22C 38/58*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***B22D 25/02*** | (2006.01) |
| ***C21D 1/60*** | (2006.01) |
| ***C22C 33/04*** | (2006.01) |
| ***B21B 1/088*** | (2006.01) |

(52) U.S. Cl.

CPC ..... *C21D 1/60* (2013.01); *C21D 8/00* (2013.01); *C21D 8/005* (2013.01); *C21D 8/0226* (2013.01); *C21D 8/0263* (2013.01); *C22C 33/04* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *C21D 2211/001* (2013.01); *C21D 2211/002* (2013.01); *C21D 2211/004* (2013.01)

(56) References Cited

FOREIGN PATENT DOCUMENTS

| | | | |
|---|---|---|---|
| JP | 4-279248 | A | 10/1992 |
| JP | 5-263182 | A | 10/1993 |
| JP | 6-100924 | A | 4/1994 |
| JP | 7-76725 | A | 3/1995 |
| JP | 7-238316 | A | 9/1995 |
| JP | 2001-3136 | A | 1/2001 |
| JP | 2002-212632 | A | 7/2002 |
| KR | 10-2013-0029437 | A | 3/2013 |
| WO | WO 2011/065479 | A1 | 6/2011 |
| WO | WO 2013/089089 | A1 | 6/2013 |

OTHER PUBLICATIONS

Written Opinion of the International Searching Authority for PCT/JP2014/082267 (PCT/ISA/237) dated Mar. 10, 2015.

Extended European Search Report for counterpart European Application No. 14871161.7, dated Jul. 13, 2017.

H-SECTION STEEL AND METHOD OF PRODUCING THE SAME

TECHNICAL FIELD OF THE INVENTION

The present invention relates to a high strength ultra thick H-section steel having excellent toughness suitable for a structural member for building structures and a method of producing the same.

Priority is claimed on Japanese Patent Application No. 2013-259410, filed on Dec. 16, 2013, the content of which is incorporated herein by reference.

RELATED ART

As building structures become higher and safety standards become stricter, the improvement of the mechanical properties, such as strength and toughness, of H-section steel used for beams and columns of building structures is required. Particularly, for high-rise building structures, a use of H-section steel having a flange thickness of 100 mm or more (hereinafter, referred to as ultra thick H-section steel) be used, and an improvement of the mechanical properties of the ultra thick H-section steel is required.

In general, as the strength of a steel material increases, or the thickness of a product increases, the toughness tends to deteriorate. Therefore, it is difficult to ensure the toughness of high strength thick steel.

In addition, H-section steel has a specific shape and is preferably produced by universal rolling. However, the rolling conditions (temperature and reduction) during the universal rolling are limited. Therefore, particularly, in the production of an ultra thick H-section steel, the temperature history and reduction during rolling, and a cooling rate during accelerated cooling significantly vary depending on each portion of a web, flanges, and fillets. As a result, the strength and toughness significantly vary depending on the positions in the cross section of an ultra thick H-section steel produced by rolling.

Furthermore, when ultra thick H-section steel is produced by applying hot rolling to steel pieces obtained through continuous casting, it is difficult to ensure the toughness through grain refinement. The reason is that it takes more time to roll an ultra thick H-section steel compared to a case of rolling a typical steel plate and the temperature of the inside of the steel particularly such as a fillet portion at the time when rolling is finished is likely to become higher than the temperature of the surface.

In the related art, regarding the improvement of the toughness of an H-section steel, for example, in Patent Documents 1 and 2, a method is proposed of refining grains through the dispersion of Ti oxides in the steel and the formation of intragranular ferrite. In addition, for example, in Patent Documents 3 to 5, a method is proposed of producing a rolled section steel having high strength and excellent toughness through temperature controlled rolling and controlled cooling in addition to fine dispersion of Ti oxides.

However, in the prior art documents, there is no specific disclosure regarding a high strength ultra thick H-section steel which has a low alloy content and excellent toughness, and which allows strength and toughness to be compatible with each other.

PRIOR ART DOCUMENTS

Patent Document

[Patent Document 1] Japanese Unexamined Patent Application, First Publication No. H4-157117

[Patent Document 2] Japanese Unexamined Patent Application, First Publication No. H4-279248

[Patent Document 3] Japanese Unexamined Patent Application, First Publication No. H5-263182

[Patent Document 4] Japanese Unexamined Patent Application, First Publication No. H7-76725

[Patent Document 5] Japanese Unexamined Patent Application, First Publication No. H7-238316

DISCLOSURE OF THE INVENTION

Problems to be Solved by the Invention

In an ultra thick H-section steel in which the flange thickness of the H-section steel is 100 mm or more, it becomes difficult to allow strength and toughness to be compatible with each other. In the related art, when a high strength ultra thick H-section steel having a yield strength or 0.2% proof stress of 450 MPa or more is produced, in order to ensure the toughness, there is a need to add alloy elements having an effect of improving toughness. Among the alloy elements, Ni is an element which increases hardenability and thus contributes to high-strengthening, and is extremely effective in increasing toughness. However, since Ni is an expensive element, there is a need to limit the added amount of Ni in order to reduce production costs.

As a method of ensuring strength while limiting the addition of alloy elements (reduce the amount of alloys), an accelerated cooling method is known of forming a low temperature transformation structure such as bainite by finishing rolling before the temperature of steel reaches a ferrite transformation start temperature ($Ar_3$ point) and starting water cooling after the rolling. Furthermore, in order to improve strength and toughness, it is known that it is preferable to refine the structure through hot rolling at a lower temperature.

However, when an ultra thick H-section steel having a flange thickness of 100 mm or more is produced through rolling, a difference in temperature between the surface and the inside tends to increase in the rolling process. As a result of an examination by a computer simulation, the inventors have found that, for example, when an H-section steel having a flange thickness of 125 mm is produced, the difference in temperature between the surface and the inside reaches even 200° C. or higher in the rolling process.

Accordingly, in the production of the ultra thick H-section steel, even when rolling is finished at a temperature at which the steel surface is close to the ferrite transformation start temperature ($Ar_3$ point), the rolling finish temperature of the inside of the steel is 1000° C. or higher and thus there is a concern of causing coarsening of austenite grains. That is, for example, when a sample is taken from the inside separated from the surface in the ultra thick H-section steel, such as a toughness evaluation portion 8 shown in the cross-sectional view of an H-section steel of FIG. 1, the toughness may be significantly deteriorated.

The present invention has been made in consideration of such circumstances, and an object thereof is to provide a high strength ultra thick H-section steel which achieves a reduction in production costs by limiting the added amount of expensive elements such as Ni, allows strength and toughness to be compatible with each other, has a low alloy content, and has excellent toughness, and a method of producing the same. The high strength ultra thick H-section steel of the present invention is not a build-up H-section steel which is formed by welding steel plates but an non-heattreated H-section steel which is formed by hot rolling, particularly, universal rolling and does not require thermal refining treatments such as quenching or tempering.

Means for Solving the Problem

In order to improve toughness, it is preferable to refine the austenite grains and to suppress the formation of coarse ferrite from the grain boundaries by the addition of alloy elements. However, in order to reduce production costs, the added amount of expensive alloy elements, particularly Ni, needs to be limited. In addition, when an ultra thick H-section steel is produced through hot rolling as described above, since a portion near the thickness center of a flange is worked at a high temperature, it is difficult to achieve austenite refinement.

The inventors have thought that in order to ensure the toughness of the ultra thick H-section steel, particles (Ti oxides) which are thermally stable even at a high temperature are dispersed in the steel and austenite grains are refined using a pinning effect at the grain boundaries by the particles. In the related art, it is reported that a technique of refining austenite grains using the pinning effect of the oxide particles is used for the improvement of the toughness of a heat affected zone (HAZ), which is exposed to a high temperature of 1400° C. or higher. However, the heating temperature and a retention time in the temperature range during rolling are significantly different from those of welding, and thus the heat affected zone (HAZ) and base metal cannot be thought of as being the same.

As described above, in the ultra thick H-section steel having a flange thickness of 100 mm or more, when the rolling finish temperature of the surface is set to $Ar_3$ point or higher, in the thickness inside portion, particularly, at a ½ position from the surface of the flange in the length direction and at a ¾ position from the surface thereof in the thickness direction, the rolling finish temperature becomes 1000° C. or higher. Therefore, in the ultra thick H-section steel, it is difficult to refine austenite grains through low temperature rolling.

The inventors suggested the application of the pinning effect of the oxide particles, which was not applied to the improvement of the toughness of base metal in the related art, to the improvement of the toughness of the base metal of the ultra thick H-section steel.

Specifically, the inventors repeatedly conducted detailed examinations on the type, size (particle size), and density of particles required for refining the austenite grain size, and a preferable steel chemical composition in a hot rolling process.

As a result, the inventors have obtained findings that the austenite grain refinement can be realized during the hot rolling process of the ultra thick H-section steel by dispersing Ti-containing fine oxides in the steel at a predetermined number density and thus the toughness is improved. That is, it was found that when fine Ti oxides are used, even at a ½ position from the surface of the flange in the length direction and at a ¾ position from the surface thereof in the thickness direction, at which the rolling temperature tends to increase, the toughness can be improved by using a structure refining effect.

In addition, when Ti-containing fine oxides are dispersed in the steel at a predetermined number density, not only at the ½ position from the surface of the flange in the length direction and the ¾ position from the surface thereof in the thickness direction, but also at other positions in the steel, for example, at a ⅙ position from the surface of the flange in the length direction and a ¼ position from the surface thereof in the thickness direction, the austenite grains are refined. Since the hardenability of the steel is improved as the austenite grains become greater, the hardenability is deteriorated due to the refinement. However, it was found that by controlling chemical components, production conditions, and the like and allowing the fraction of bainite in the metal structure at the ⅙ position from the surface of the flange in the length direction and at the ¼ position from the surface thereof in the thickness direction to be 80% or more, strength required of a high strength H-section steel can be ensured.

Furthermore, it could be seen that regarding Nb, which is considered to form precipitates or suppress recrystallization and thus contribute to structure refinement, in the ultra thick H-section steel of the present invention in which Ti oxides are used while the C content is 0.05% or higher, the toughness is deteriorated due to the formation of NbC. In addition, it could be seen that, even regarding B, which is considered to increase hardenability and contribute to improving strength and toughness through the addition of a very small amount of B, in the ultra thick H-section steel of the present invention in which Ti oxides are used, the strength is deteriorated due to the formation of BN. As described above, it was found that Nb and B, which typically exhibit an effect of improving strength and toughness, are elements which are harmful to the ultra thick H-section steel of the present invention in which Ti oxides are used and need to be limited in amount.

The present invention has been made on the basis of the findings, and the gist thereof is as follows.

(1) According to an aspect of the present invention, there is provided an H-section steel including, by mass %: C: 0.05% to 0.16%; Si: 0.01% to 0.50%; Mn: 0.80% to 2.00%; Ni: 0.05% to 0.50%; V: 0.01% to 0.20%; Ti: 0.005% to 0.030%; N: 0.0010% to 0.0100%; O: 0.0005% to 0.0100%; Cr: 0% to 0.50%; Cu: 0% to 0.30%; Mo: 0% to 0.30%; W: 0% to 0.50%; Al: limited to 0.005% or less; Nb: limited to 0.010% or less; B: limited to 0.0005% or less; and a remainder including Fe and impurities, in which a carbon equivalent $C_{eq}$ obtained by the following Equation i is 0.35% to 0.50%, a density of Ti oxides having a grain size of 0.01 μm to 3.0 μm is 30 pieces/mm$^2$ or more, a thickness of a flange is 100 mm to 150 mm, at a ⅙ position from a surface of the flange in a length direction and at a ¼ position from the surface thereof in a thickness direction, an area fraction of bainite is 80% or more, a yield strength or 0.2% proof stress is 450 MPa or more, and a tensile strength is 550 MPa or more, at a ½ position from the surface of the flange in the length direction and at a ¾ position from the surface thereof in the thickness direction, a Charpy absorbed energy at 21° C. is 100 J or more, and an average austenite grain size is 50 μm to 200 μm.

$$C_{eq}=C+Mn/6+(Cr+Mo+V)/5+(Ni+Cu)/15 \quad \text{(Equation i)}$$

here, C, Mn, Cr, Mo, V, Ni, and Cu represent the amount % of each element and the amount of an element not contained is 0%.

(2) The H-section steel according to (1) may include, by mass %, one of or two or more of Cr: 0.01% to 0.50%, Cu: 0.01% to 0.30%, Mo: 0.001% to 0.30%, and W: 0.01% to 0.50%.

(3) According to another aspect of the present invention, there is provided a method of producing an H-section steel according to (1) or (2): a refining process of deoxidizing a molten steel to allow a concentration of oxygen in the molten steel to be 0.0005% to 0.0100%, then adding Ti, and adjusting components of the molten steel to include by mass %, C: 0.05% to 0.16%, Si: 0.01% to 0.50%, Mn: 0.80% to 2.00%, Ni: 0.05% to 0.50%, V: 0.01% to 0.20%, Ti: 0.005% to 0.030%, N: 0.0010% to 0.0100%, O: 0.0005% to 0.0100%, Cr: 0% to 0.50%, Cu: 0% to 0.30%, Mo: 0% to 0.30%, W: 0% to 0.50%, Al: limited to 0.005% or less, Nb: limited to 0.010% or less, B: limited to 0.0005% or less, and a remainder including Fe and impurities, and to have a carbon equivalent $C_{eq}$ obtained by the following Equation ii of 0.35% to 0.50%; a casting process of casting the molten steel to obtain a steel piece; a heating process of heating the steel piece to 1100° C. to 1350° C.; a hot rolling process of performing hot rolling on the heated steel piece so that a surface temperature of the steel piece is 800° C. or higher, thereby obtaining an H-section steel; and a cooling process of water-cooling the H-section steel after the hot rolling process, in which in the cooling process, water cooling conditions are controlled so that the cooled surface temperature bounce back to within a temperature range of 300° C. to 700° C. after heat-recuperation.

$$C_{eq}=C+Mn/6+(Cr+Mo+V)/5+(Ni+Cu)/15 \quad \text{(Equation ii)}$$

(4) In the method of producing an H-section steel according to (3), the components of the molten steel may include, by mass %, one of or two or more of Cr: 0.01% to 0.50%, Cu: 0.01% to 0.30%, Mo: 0.001% to 0.30%, and W: 0.01% to 0.50%.

Effects of the Invention

According to the above aspects of the present invention, it is possible to obtain a high strength ultra thick H-section steel which has a flange thickness of 100 mm to 150 mm, has excellent toughness, a yield strength or 0.2% proof stress of 450 MPa or more, and a tensile strength of 550 MPa or more. The high strength ultra thick H-section steel obtained according to the above aspects of the present invention can be produced without adding a large amount of alloys or reducing carbon to the ultra low carbon level, which causes significant steel-making loads. Accordingly, this makes it possible to reduce production costs and shorten production time, thereby achieving a significant reduction in costs. Therefore, the reliability of large buildings can be improved without sacrificing cost efficiency, and hence, the present invention makes an extremely significant contribution to industries.

EMBODIMENTS OF THE INVENTION

Hereinafter, a high strength ultra thick H-section steel according to an embodiment of the present invention (hereinafter, sometimes referred to as an H-section steel according to the embodiment) will be described in detail.

Figure 1:
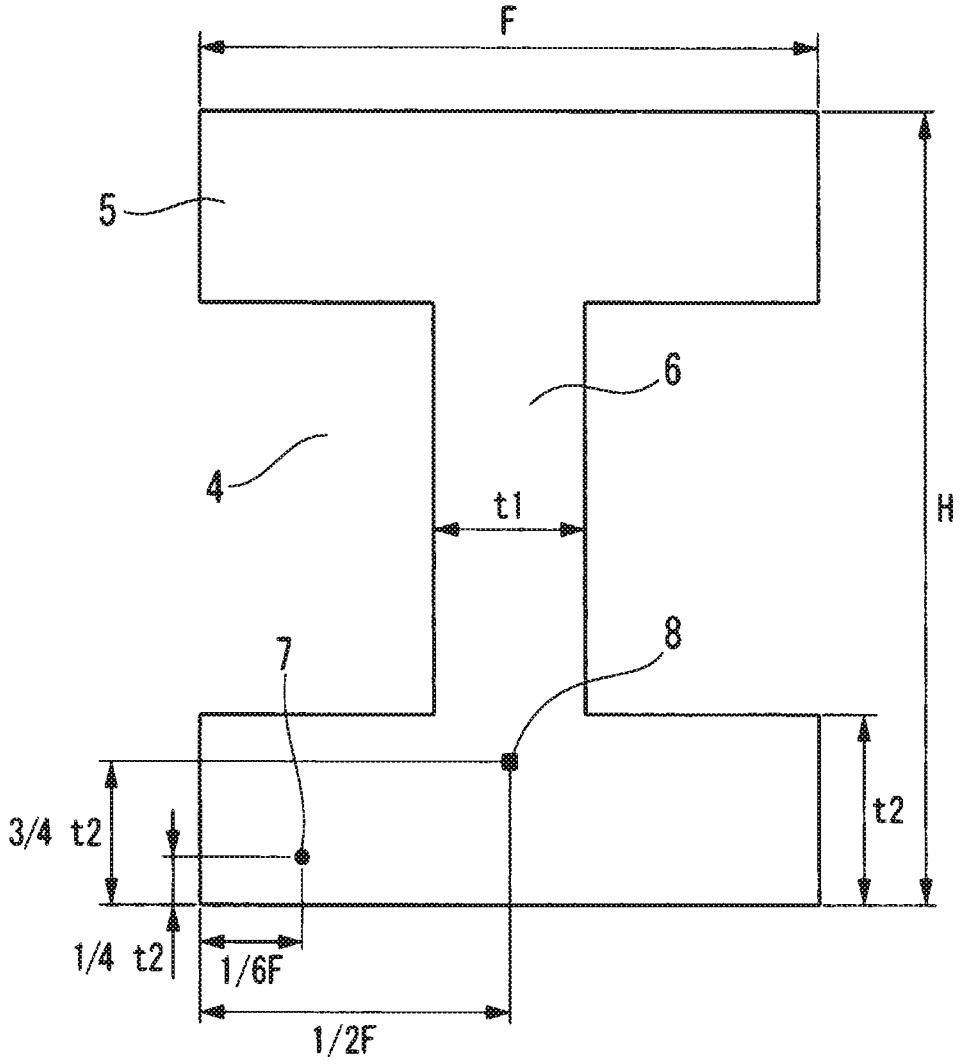
FIG. 1 is a view illustrating a cross-sectional shape of an H-section steel.

FIG. 1 is a view illustrating the cross-sectional shape of the H-section steel. An H-section steel 4 includes a flange 5 and a web 6. The entire length of the flange is represented by F, the height thereof is represented by H, the thickness of the web is represented by $t_1$, and the thickness of the flange is represented by $t_2$. A strength evaluation portion is denoted by reference numeral 7, and a toughness evaluation portion is denoted by reference numeral 8.

In the embodiment, a portion at a ½ position from the surface of the flange of the H-section steel in the length direction and at a ¾ position from the surface thereof in the thickness direction is defined as the toughness evaluation portion 8. The toughness evaluation portion 8 corresponds to a portion near the center of a steel piece and is thus a portion that slowly cools after casting. In addition, the portion is a portion in which the hot rolling temperature is also increased. That is, the toughness evaluation portion 8 is a portion of which the structure is likely to be coarsened. In the case of an ultra thick H-section steel having a flange thickness of 100 mm to 150 mm, it is difficult for the toughness evaluation portion 8 in the steel to achieve austenite grain refinement because the rolling finish temperature at the surface is high. However, even in such a portion, when a pinning effect by fine Ti oxides is used, the austenite grain refinement can be realized, and good toughness can be ensured.

In addition, in the embodiment, a portion at a ⅙ position from the surface of the flange in the length direction and at a ¼ position from the surface thereof in the thickness direction is defined as the strength evaluation portion 7. The strength evaluation portion 7 is a portion which is considered to have an average structure, and when the area fraction of bainite in the structure of the strength evaluation portion 7 is 80% or more, the strength of the H-section steel can be ensured.

Even when the amount of Ni, which contributes to improving toughness and strength, is limited, by controlling $C_{eq}$ and applying accelerated cooling after hot rolling to the manufacturing process, the formation of ferrite transformed from austenite grain boundaries is suppressed. As a result, the area fraction of bainite to the structure of the strength evaluation portion 7 can be allowed to be 80% or more.

In the H-section steel according to the embodiment, Nb or B forms Nb carbides or BN and thus deteriorates toughness or strength. Therefore, the amounts of Nb and B have to be limited.

The reason for limiting the component range (chemical composition) of the H-section steel according to the embodiment will be described. Here, the symbol "%" of the components indicates mass %. The chemical components described below have analysis values in the molten steel and this value may be considered as an average value in the entire steel.

(C: 0.05% to 0.16%)

C is an element effective in high-strengthening the steel. In order to obtain this effect, the lower limit value of the C content is set to 0.05%. The lower limit of the C content is preferably 0.08%. On the other hand, when the C content is more than 0.16%, coarse carbides are formed and toughness is deteriorated. Therefore, the upper limit of the C content is set to 0.16%. In order to further improve the toughness, the upper limit of the C content is preferably set to 0.12%.

(Si: 0.01% to 0.50%)

Si is a deoxidizing element and contributes to improving strength. In order to obtain these effects, the lower limit of the Si content is set to 0.01%. On the other hand, when the Si content is excessive, formation of a martensite-austenite mixture (MA), which is a hard phase, is promoted and toughness is deteriorated. Therefore, the upper limit of the Si content is set to 0.50%. In order to ensure the toughness, the upper limit of the Si content is preferably 0.30% and more preferably 0.20%.

(Mn: 0.80% to 2.00%)

Mn is an element effective in increasing hardenability and thus high-strengthening the steel. In order to obtain these effects, the lower limit of the Mn content is set to 0.80%. The lower limit of the Mn content is preferably set to 1.00%. On the other hand, when the Mn content is more than 2.00%, MnS, which is present in the steel, is coarsened and toughness is deteriorated. Therefore, the upper limit of the Mn content is set to 2.00%.

(Ni: 0.05% to 0.50%)

Ni is a significantly effective element for increasing the strength and toughness of the steel. In order to ensure the toughness of the ultra thick H-section steel, the lower limit of the Ni content is set to 0.05%. The lower limit of the Ni content is preferably set to 0.10%. On the other hand, Ni is an expensive element, and when the Ni content is more than 0.50%, alloying costs are increased. Thus, the upper limit of the Ni content is set to 0.50%. The upper limit of the Ni content is preferably 0.30%.

(V: 0.01% to 0.20%)

V is an element that contributes to improving hardenability. In addition, V is an element that further forms carbonitrides, and contributes to grain refinement and precipitation strengthening. In order to obtain these effects, the lower limit of the V content is set to 0.01%. The lower limit of the V content is preferably 0.05%. On the other hand, when the V content is excessive, precipitates are coarsened, possibly leading to a deterioration in toughness. Therefore, the upper limit of the V content is set to 0.20%. The upper limit of the V content is preferably 0.08%.

(Ti: 0.005% to 0.030%)

Ti is an element that forms Ti oxides and contributes to austenite grain refinement due to pinning, and is an element effective in improving toughness. In order to obtain these effects, the lower limit of the Ti content is set to 0.005% or more. However, when the Ti content is more than 0.030%, coarse TiC is formed and toughness is deteriorated. Thus, the upper limit of the Ti content is set to 0.030%. In order to suppress a deterioration in toughness due to formation of coarse TiC precipitates, the upper limit of the Ti content is preferably 0.020%.

(N: 0.0010% to 0.0100%)

N is an element that forms TiN and VN and thus contributes to grain refinement and precipitation strengthening. In order to obtain these effects, the lower limit of the N content is set to 0.0010%. On the other hand, when the N content is excessive, the toughness of the base metal is deteriorated. Therefore, the upper limit of the N content is set to 0.0100%. The upper limit of the N content is preferably 0.0060%.

(O: 0.0005% to 0.0100%)

O is an element necessary for formation of Ti oxides in the H-section steel according to the embodiment. Therefore, the lower limit of the O content is set to 0.0005%. On the other hand, when the O content is excessive, oxides are coarsened, possibly leading to a deterioration in toughness. Therefore, the upper limit of the O content is set to 0.0100%. The upper limit of the O content is preferably 0.0050%.

(Al: 0.005% or lower)

Al binds to O priorly to Ti in the molten steel and suppresses the formation of Ti oxides. Therefore, in order to form Ti oxides, it is preferable that the Al content is as low as possible. It is preferable that Al is not substantially included. However, in consideration of industrial constraints, an allowable upper limit of the Al content is set to 0.005%. The upper limit of the Al content is preferably 0.003%.

(Nb: 0.010% or less)

Nb is a useful element that typically contributes to structure refinement, precipitation strengthening, and further improvement of hardenability. However, there is a new finding that when the H-section steel according to the embodiment contains Nb, the toughness is significantly deteriorated due to precipitation of NbC. Therefore, it is preferable that Nb is not contained, and the upper limit of the Nb content is limited to 0.010%.

(B: 0.0005% or less)

B is typically an element that significantly contributes to improving hardenability through the addition of a very small amount of B. However, when B is included in the H-section steel according to the embodiment that contains Ti oxides, BN is precipitated to fine Ti oxides as nuclei. It is newly found that BN acts as a nucleus of ferrite formation, and causes a deterioration in hardenability and a deterioration in strength. Therefore, from the viewpoint of ensuring strength, it is preferable that the B content is as low as possible, and the upper limit of the B content is limited to 0.0005%.

(Mg: 0.0003% or less)

Mg binds to O priorly to Ti in the molten steel and suppresses the formation of Ti oxides. Therefore, it is preferable that the Mg content is as low as possible. It is preferable that Mg is not substantially included. However, there may be cases where Mg is incorporated in the manufacturing process. Therefore, in consideration of industrial constraints, the upper limit of the Mg content may be set to 0.0003%.

(Ca: 0.0003% or less)

Ca binds to O priorly to Ti in the molten steel and suppresses the formation of Ti oxides. Therefore, it is preferable that the Ca content is as low as possible. It is preferable that Ca is not substantially included. However, in consideration of industrial constraints, the upper limit of the Ca content may be set to 0.0003%.

The H-section steel according to the embodiment basically contains the above-described elements and the remainder consisting of Fe and impurities. However, in order to increase strength by improving hardenability, the steel may further include one of or two or more of Cr, Cu, Mo, and W as required within the following ranges. These elements are not necessarily contained in the steel. Therefore, the lower limits of the elements are 0%.

(Cr: 0.01% to 0.50%)

Cr is an element that contributes to high-strengthening the steel by improving hardenability. In the case of obtaining the effect of improving hardenability, 0.01% or more of Cr is preferably included, and 0.10% or more of Cr is more preferably included. On the other hand, when the Cr content is more than 0.50%, formation of MA is promoted or Cr carbides are coarsened, possibly deteriorating the toughness. Therefore, the upper limit of the Cr content is limited to 0.50%. The upper limit of the Cr content is more preferably 0.30%.

(Cu: 0.01% to 0.30%)

Cu is an element that contributes to high-strengthening the steel by hardenability improvement and precipitation strengthening. In a case of obtaining these effects, 0.01% or more of Cu is preferably included, and 0.10% or more of Cu is more preferably included. On the other hand, when the Cu content is excessive, formation of MA is promoted, possibly deteriorating toughness. Therefore, the upper limit of the Cu content is set to 0.30%. The upper limit of the Cu content is more preferably 0.20%.

(Mo: 0.001% to 0.30%)

Mo is an element that contributes to high-strengthening the steel by improving hardenability. In order to obtain these effects, 0.001% or more of Mo is preferably included, and 0.01% or more of Mo is more preferably included. On the other hand, when the Mo content is more than 0.30%, formation of MA is promoted, possibly deteriorating toughness. Therefore, the upper limit of the Mo content is preferably set to 0.30%. In order to prevent a deterioration in toughness, the upper limit of the Mo content is more preferably 0.20%.

(W: 0.01% to 0.50%)

Similar to Mo, W is an element that contributes to high-strengthening the steel by improving hardenability. In order to obtain these effects, the lower limit of the W content is preferably set to 0.01%. On the other hand, when the W content is more than 0.50%, formation of MA is promoted, possibly deteriorating toughness. Therefore, the upper limit of the W content is preferably set to 0.50%. The upper limit of the W content is more preferably 0.30%.

The remainder of the above-described components includes Fe and impurities.

S which is unavoidably contained in the steel as the impurities causes formation of coarse sulfides that deteriorates toughness, and is thus preferably limited to 0.020% or less. In addition, P which is unavoidably contained in the steel as the impurities is preferably limited to 0.03% or less.

(Carbon Equivalent $C_{eq}$: 0.35% to 0.50%)

In the present invention, in order to increase hardenability to form bainite, the carbon equivalent $C_{eq}$ expressed by the following Equation (1) is set to 0.35% to 0.50%. When the $C_{eq}$ is less than 0.35%, bainite is not sufficiently formed, which results in a deterioration in the strength and toughness. The $C_{eq}$ is preferably set to 0.38% and more, and is more preferably set to 0.40% or more. On the other hand, when the $C_{eq}$ is more than 0.50%, the strength is excessively increased and the toughness is deteriorated. The $C_{eq}$ is preferably set to 0.45% or less, and is more preferably set to 0.43% or less.

The carbon equivalent $C_{eq}$ is an index of hardenability and is obtained by the well-known following Equation (1). Here, C, Mn, Cr, Mo, V, Ni, and Cu represent the amount (mass %) of the elements contained. The amount of the elements which are not contained is set to 0%.

$$C_{eq}=C+Mn/6+(Cr+Mo+V)/5+(Ni+Cu)/15 \quad \text{Equation (1)}$$

Next, the microstructure of the H-section steel according to the embodiment will be described.

In the case of an ultra thick H-section steel, the rolling finish temperature near the surface is low and the cooling rate during water cooling is high. Thus, the metallographic structure (grain size) of the steel is likely to be fine. On the other hand, the rolling finish temperature of the inside is high and the austenite grains are coarsened. In addition, the cooling rate during water cooling is low, and the intergranular ferrite and the bainite structure are coarsened. Therefore, the toughness tends to deteriorate.

FIG. 1 is a view illustrating the cross-sectional shape of an H-section steel. The H-section steel 4 includes the flange 5 and the web 6. The entire length of the flange is represented by F, the height thereof is represented by H, the thickness of the web is represented by $t_1$, and the thickness of the flange is represented by $t_2$. In FIG. 1, the strength evaluation portion is denoted by reference numeral 7, and the toughness evaluation portion is denoted by reference numeral 8. The strength evaluation portion 7 illustrated in FIG. 1 is a portion that is at a ⅙ position from the surface of the flange in the length direction and at a ¼ position from the surface thereof in the thickness direction and can be considered to have an average structure in the H-section steel according to the embodiment. A sample for evaluation of strength was taken from this portion and the observation of the microstructure and the measurement of the area fraction of bainite were performed. The metallographic structure can be determined by observation with an optical microscope. The area fraction of bainite can be calculated as a ratio of the number of grains in each structure by arranging measurement points in a lattice shape in which one side is 50 μm and distinguishing the structures with 300 measurement points using a structure image photographed at a magnification of 200 times using an optical microscope.

Bainite contributes to increasing strength. In the H-section steel according to the embodiment, in order to ensure the strength, it is necessary that the steel structure of the strength evaluation portion 7 in FIG. 1 includes bainite with an area fraction of 80% or more. The remainder includes one of or two or more of ferrite, pearlite, and martensite-austenite constituent. Since an increase in the area fraction of bainite contributes to improving the strength, the upper limit of the area fraction of bainite does not need to be defined and may be 100%.

In addition, in the ultra thick H-section steel, since the rolling finish temperature in a portion near the thickness center is high, the austenite grains are easily coarsened. Furthermore, since the cooling rate during water cooling is low, intergranular ferrite is likely to be coarsened. Therefore, particularly, the toughness evaluation portion 8 shown in FIG. 1 has the lowest toughness. The position of the toughness evaluation portion 8 is at a ½ position from the surface of the flange in the length direction and at a ¾ position from the surface thereof in the thickness direction.

A sample was taken from the portion having the lowest toughness (the toughness evaluation portion 8) and the toughness was evaluated. In addition, the microstructure was observed at the same portion to evaluate the grain size of the austenite grains. The austenite grain size mentioned in the embodiment is a so-called prior austenite grain size before low temperature transformation by cooling after hot rolling, and is measured using a structure image obtained using an optical microscope at a magnification of 50 times. Specifically, the number of γ grains (austenite grains) present in a range of about 1 mm to 2 mm square was counted using the structure image, and the area fraction per γ grain was calculated and converted into an equivalent circle diameter (diameter). The number of the γ grain in the boundary between the measurement ranges of the structure image was counted as 0.5. In addition, by using a sample taken from the same portion, observation was performed with a transmission electron microscope (TEM), and the precipitation density of Ti oxides was measured.

The inventors have found that in the case of ensuring predetermined toughness for the ultra thick H-section steel, it is necessary to control the average of the austenite grain sizes in the toughness evaluation portion to 50 μm to 200 μm. In order to improve the toughness, as the austenite grain size decreases, it is more preferable. However, when the austenite grain size is refined, the hardenability is deteriorated and there is a concern that the strength may be deteriorated. Therefore, from the viewpoint of strength, the average of the austenite grain size is preferably set to 50 μm or more.

The inventors have found that by including Ti oxides having a particle size (equivalent circle diameter) of 0.01 μm to 3.0 μm at a density of 30 pieces/$mm^2$ or more, it is possible to allow the average of the austenite grain sizes to be 200 μm or less due to the refinement of austenite grains by pinning effect and recrystallization effect by rolling. In addition, it was confirmed that in this case, the toughness was improved. The number of Ti oxide particles is influenced by the Ti content and the O content, and the upper limit thereof is not particularly limited. However, for practical uses, the upper limit thereof is preferably 1000 pieces/$mm^2$ or less, and more preferably 500 pieces/$mm^2$ or less. In addition, it is assumed that the H-section steel according to the embodiment is heated at a temperature of 1350° C. at the maximum and for a period of time of 5 hours at most. The inventors confirmed that even when the steel pieces are heated under such conditions, the precipitation density of the Ti oxides is not lowered, and the pinning effect of the austenite grains is not lost.

Even when the particle size of the Ti oxides is small, no problem arises. However, since an extraction replica is used for the measurement, the observation is not easy when the particle size is less than 0.01 μm. Thus, from the viewpoint of measurement accuracy and quantitativity, as an object for counting the number of particles, Ti oxides having a particle size of 0.01 μm or more were used. When the particle size is more than 3.0 μm, a sufficient pinning effect cannot be obtained. Therefore, the upper limit of the particle size of the Ti oxides is set to 3.0 μm.

Elements contained in the Ti oxides can be identified by an energy dispersive X-ray analyzer (EDX) attached to a TEM.

In the embodiment, Ti oxides indicate TiO, $TiO_2$, $Ti_2O_3$, a complex oxide of TiO, $TiO_2$, or $Ti_2O_3$ and an oxide that does not contain Ti, and a complex inclusion of the Ti oxide or the complex oxide and a sulfide. Examples of the oxide that does not contain Ti include an Si-based oxide such as $SiO_2$, an Al-based oxide such as $Al_2O_3$, an Mg-based oxide, and a Ca-based oxide.

The thickness of the flange of the H-section steel according to the embodiment is set to 100 mm to 150 mm. The reason for limiting the lower limit of the thickness of the flange to 100 mm is that for example, a strength member having a thickness of 100 mm or more is required as an H-section steel used for high-rise building structures. On the other hand, when the thickness of the flange is more than 150 mm, a sufficient cooling rate cannot be obtained and it is difficult to ensure the toughness. Thus, the upper limit of the thickness of the flange is set to 150 mm. Although the thickness of the web is not particularly defined, the thickness is preferably 50 mm to 150 mm.

The thickness ratio between the flange and the web, that is, a value obtained by dividing the thickness of the flange by the thickness of the web (thickness ratio between flange and web) is preferably set to 0.5 to 2.0 on the assumption that the H-section steel is produced by hot rolling. When the thickness ratio between the flange and the web is more than 2.0, the web may be deformed into a wavy shape. On the other hand, when the thickness ratio between the flange and the web is less than 0.5, the flange may be deformed into a wavy shape.

For the mechanical properties, the target values are set as follows: the yield strength or 0.2% proof stress at normal temperatures is set to 450 MPa or more; and the tensile strength at normal temperatures is set to 550 MPa or more. Further, the Charpy absorbed energy at 21° C. is set to 100 J or more. The excessively high strength possibly causes a deterioration in toughness. Thus, it is preferable to set the yield strength or 0.2% proof stress at normal temperatures to 550 MPa or less, and set the tensile strength at normal temperatures to 680 MPa or less.

Next, a preferred method of producing the H-section steel according to the embodiment will be described.

In the case of producing the H-section steel according to the embodiment, first, for example, the temperature of the molten steel is controlled to 1650° C. or less, deoxidation was performed to allow the concentration of oxygen in the molten steel to be 0.0005% to 0.0100%, and Ti is added. Next, the chemical composition of the molten steel is adjusted (refining process).

By performing such control operations, Ti oxides having a grain size of 0.01 μm to 3.0 μm are formed in the steel piece cast by using the molten steel at a density of 30 pieces/$mm^2$ or more. When the concentration of oxygen in the molten steel is more than 0.0100%, the oxides are coarsened, and the toughness is deteriorated. Therefore, the upper limit thereof is set to 0.0100%. The upper limit thereof is preferably 0.0080%, more preferably 0.0060%, and even more preferably 0.0040%. In addition, oxygen is an element necessary for formation of Ti oxides, and thus the concentration of oxygen in the molten steel needs to be 0.0005% or higher.

After the refining process, steel pieces are obtained through casting (casting process). As for the casting, from the viewpoint of productivity, continuous casting is preferable. However, the steel may be cast to a beam blank having a shape close to the shape of an H-section steel to be produced. Further, the thickness of the steel piece is preferably 200 mm or more from the viewpoint of productivity and preferably 350 mm or less in consideration of heating temperature uniformity in hot rolling.

Next, the steel pieces are heated (heating process) and subjected to hot rolling (hot rolling process). The lower limit of the heating temperature of the steel piece is set to 1100° C. to sufficiently solid-solute elements, such as V, for forming carbides and nitrides. On the other hand, when the heating temperature is higher than 1350° C., scale on the surface of the steel piece, which is a raw material, is liquefied and causes difficulties in production. Thus, the upper limit of the heating temperature is set to 1350° C. In the embodiment, the hot rolling includes rough rolling performed using a roughing mill, intermediate rolling performed using an intermediate rolling mill, and finish rolling performed using a finishing mill.

In the hot rolling, it is preferable that rolling is performed by controlling the rolling temperature and the reduction. This is because the austenite grain size may be further refined by recrystallization during rolling.

It is preferable that the austenite grains are refined to ensure toughness. On the other hand, it is preferable that the size of austenite grains is increased to increase hardenability in order to ensure strength. Accordingly, originally, it is preferable that the rolling temperature is lowered to ensure toughness, and the rolling temperature is increased to ensure strength.

However, in the H-section steel according to the embodiment, as described above, the average of the austenite grain sizes is 200 μm or less due to the pinning effect of the Ti oxides, and thus refinement through rolling at an excessively low temperature is not necessary. In addition, when the finish temperature of the hot rolling is excessively low, the hardenability of the strength evaluation portion 7 at a ⅙ position from the surface of the flange in the length direction near the surface and at a ¼ position from the surface thereof in the thickness direction is decreased, and predetermined strength may not be obtained. Therefore, in the hot rolling process, rolling is finished at a surface temperature of 800° C. or higher. It can be thought that the thermal stability of the Ti oxides is high and there are almost no changes in the pinning effect due to variations in the rolling process. Therefore, from the viewpoint of ensuring strength, it is preferable that the steel having high hardenability is rolled at a low temperature and the steel having low hardenability is rolled at a high temperature. That is, it is preferable that the temperature is appropriately controlled according to the chemical composition of the steel.

In the case of lowering the rolling temperature, it is effective to perform water cooling rolling between rolling passes for one or more passes during the finish rolling. The interpass water cooling rolling is a method in which the surface temperature of the flange is cooled to 700° C. or lower and then rolling is performed in the during recuperation. The interpass water cooling rolling is a method of rolling in which, by performing water cooling between rolling passes, difference in temperature between the surface portion of the flange and the inside of the flange is imparted. During interpass water cooling rolling, it is possible to introduce work strain into the inside of the steel in the thickness direction even when the reduction is small. Further, by lowering the rolling temperatures within a short period of time through water cooling, the productivity can be improved.

After the finish rolling (hot rolling), in order to obtain high strength, the flange and the web are water-cooled (cooling process). The water cooling can be performed by water spray with a spray or water immersion cooling in a water tank. In the embodiment, it is preferable to perform water cooling such that a cooling rate from 800° C. to 600° C. is 2.2° C./s or more at the strength evaluation portion (the position of 7 of FIG. 1). When the cooling rate from 800° C. to 600° C. is less than 2.2° C./s, there is a possibility that the desired hardened structure cannot be obtained.

Regarding the cooling process, the water cooling is stopped under the condition that the cooled surface temperature bounce back to within a temperature range of 300° C. to 700° C. after heat-recuperation. This is because, when the recuperated temperature (surface temperature after recuperation) is lower than 300° C., self-tempering is not sufficient and MA which has an adverse effect on the toughness is not sufficiently decomposed and remains (for example, the area fraction thereof in the toughness evaluation portion of the H-section steel becomes higher than 3.0%), resulting in a deterioration in the toughness. Further, under the condition that the recuperated temperature is higher than 700° C., ferrite formed from the prior austenite grain boundaries is significantly coarsened to cause a deterioration in toughness or the tempering temperature is excessively increased even near the thickness surface to cause a deterioration in strength in some cases.

As for the water cooling conditions, the reason for specifying the not the water cooling stop temperature but recuperated temperature is that a difference in cooling rate between the surface and the inside of the ultra thick H-section steel is large and the inside temperature is affected by the water cooling time. That is, the surface temperature can be cooled to 200° C. or lower in a short period of time after the cooling is started. However, the inside cooling rate is low and thus the inside temperature is controlled by the water cooling time to manage the thermal history in the recuperated temperature. As long as the relationship between the cooling rate, the cooling time, and the recuperated temperature is measured or estimated in advance by a computer simulation, the recuperated temperature of the ultra thick H-section steel can be controlled by the cooling time.

The hot rolling process may also employ a process of performing primary rolling, cooling to 500° C. or lower, then reheating to 1100° C. to 1350° C., and performing secondary rolling, that is, so-called two-heat rolling. With the two-heat rolling, there is little plastic deformation in the hot rolling and the drop in temperature in the rolling process also becomes smaller, and thus, the heating temperature can be lowered.

EXAMPLES

The present invention will be described on the basis of the following Examples.

The steel having the chemical composition shown in Table 1 was melted and to produce steel pieces having a thickness of 240 mm to 300 mm by continuous casting. The steel was melted in a converter and was subjected to primary deoxidation to control the amount of dissolved oxygen. Thereafter, Ti was added and alloys were further added to adjust the components. As required, vacuum degassing treatment was performed. Then the steel pieces obtained were subjected to heating and hot rolling, thereby producing an H-section steel. The components shown in Table 1 were results obtained by measuring samples taken from the molten steel.

TABLE 1

| COMPONENT | CHEMICAL COMPOSITION [mass %] | | | | | | | | | |
|---|---|---|---|---|---|---|---|---|---|---|
| NO. | C | Si | Mn | S | Ni | V | Al | Ti | N | O |
| 1 | 0.158 | 0.03 | 1.01 | 0.0070 | 0.09 | 0.080 | 0.004 | 0.015 | 0.0089 | 0.0020 |
| 2 | 0.155 | 0.01 | 1.22 | 0.0145 | 0.20 | 0.061 | 0.005 | 0.011 | 0.0095 | 0.0024 |
| 3 | 0.130 | 0.10 | 1.04 | 0.0181 | 0.31 | 0.059 | 0.001 | 0.025 | 0.0060 | 0.0071 |
| 4 | 0.129 | 0.48 | 1.29 | 0.0093 | 0.47 | 0.101 | | 0.021 | 0.0052 | 0.0031 |
| 5 | 0.111 | 0.26 | 1.49 | 0.0052 | 0.32 | 0.179 | 0.001 | 0.008 | 0.0033 | 0.0034 |
| 6 | 0.107 | 0.20 | 1.40 | 0.0023 | 0.24 | 0.013 | | 0.010 | 0.0041 | 0.0055 |
| 7 | 0.110 | 0.28 | 1.55 | 0.0069 | 0.21 | 0.034 | | 0.007 | 0.0015 | 0.0019 |
| 8 | 0.102 | 0.34 | 1.84 | 0.0088 | 0.30 | 0.043 | 0.003 | 0.006 | 0.0029 | 0.0014 |
| 9 | 0.089 | 0.11 | 1.60 | 0.0121 | 0.11 | 0.070 | 0.001 | 0.018 | 0.0032 | 0.0047 |
| 10 | 0.103 | 0.11 | 1.42 | 0.0130 | 0.33 | 0.062 | | 0.012 | 0.0026 | 0.0023 |
| 11 | 0.101 | 0.33 | 1.14 | 0.0092 | 0.45 | 0.025 | 0.003 | 0.011 | 0.0038 | 0.0020 |
| 12 | 0.090 | 0.07 | 1.37 | 0.0084 | 0.22 | 0.058 | | 0.012 | 0.0029 | 0.0017 |
| 13 | 0.090 | 0.36 | 1.26 | 0.0070 | 0.29 | 0.044 | 0.004 | 0.009 | 0.0044 | 0.0010 |
| 14 | 0.079 | 0.23 | 1.60 | 0.0044 | 0.17 | 0.059 | | 0.013 | 0.0017 | 0.0018 |
| 15 | 0.077 | 0.06 | 1.58 | 0.0058 | 0.20 | 0.057 | | 0.014 | 0.0028 | 0.0032 |
| 16 | 0.053 | 0.40 | 1.40 | 0.0029 | 0.44 | 0.073 | | 0.009 | 0.0026 | 0.0026 |
| 17 | 0.051 | 0.43 | 1.77 | 0.0059 | 0.34 | 0.069 | | 0.015 | 0.0030 | 0.0029 |

TABLE 1-continued

| | | | | | | | | | | |
|---|---|---|---|---|---|---|---|---|---|---|
| 18 | 0.180 | 0.09 | 1.22 | 0.0080 | 0.20 | 0.057 | | 0.012 | 0.0033 | 0.0021 |
| 19 | 0.030 | 0.29 | 1.62 | 0.0062 | 0.19 | 0.058 | | 0.011 | 0.0020 | 0.0018 |
| 20 | 0.098 | 0.70 | 1.41 | 0.0072 | 0.20 | 0.055 | | 0.010 | 0.0031 | 0.0018 |
| 21 | 0.090 | 0.39 | 2.21 | 0.0077 | 0.21 | 0.054 | | 0.020 | 0.0029 | 0.0015 |
| 22 | 0.115 | 0.27 | 1.45 | 0.0050 | 0.02 | 0.046 | | 0.012 | 0.0034 | 0.0022 |
| 23 | 0.125 | 0.32 | 1.59 | 0.0053 | 0.23 | 0.055 | 0.029 | 0.009 | 0.0042 | 0.0020 |
| 24 | 0.123 | 0.31 | 1.44 | 0.0102 | 0.24 | 0.057 | | 0.032 | 0.0045 | 0.0037 |
| 25 | 0.109 | 0.30 | 1.40 | 0.0098 | 0.30 | 0.056 | | 0.012 | 0.0036 | 0.0001 |
| 26 | 0.151 | 0.27 | 1.81 | 0.0070 | 0.32 | 0.091 | | 0.009 | 0.0030 | 0.0029 |
| 27 | 0.080 | 0.15 | 1.20 | 0.0069 | 0.15 | 0.054 | | 0.018 | 0.0022 | 0.0028 |
| 28 | 0.128 | 0.39 | 1.78 | 0.0066 | 0.16 | 0.080 | | 0.014 | 0.0025 | 0.0027 |
| 29 | 0.127 | 0.28 | 1.57 | 0.0051 | 0.25 | 0.059 | | 0.011 | 0.0034 | 0.0023 |
| 30 | 0.112 | 0.29 | 1.51 | 0.0072 | 0.20 | 0.060 | | 0.012 | 0.0039 | 0.0090 |

| COMPONENT | CHEMICAL COMPOSITION [mass %] | | | | | | $C_{eq}$ | |
|---|---|---|---|---|---|---|---|---|
| NO. | Nb | B | Cr | Cu | Mo | W | (%) | REMARKS |
| 1 | | | | | 0.29 | | 0.41 | STEEL OF |
| 2 | | 0.0005 | | 0.28 | | | 0.40 | INVENTION |
| 3 | 0.009 | | 0.47 | | | | 0.43 | |
| 4 | | | | | | | 0.40 | |
| 5 | 0.006 | 0.0004 | | | | 0.40 | 0.42 | |
| 6 | | | | | | | 0.36 | |
| 7 | | | | | | | 0.39 | |
| 8 | 0.004 | | | | | | 0.44 | |
| 9 | 0.004 | | | 0.14 | | | 0.40 | |
| 10 | | | | | | | 0.37 | |
| 11 | | | 0.20 | 0.29 | 0.05 | | 0.40 | |
| 12 | | 0.0004 | | | 0.13 | | 0.37 | |
| 13 | | | | 0.20 | 0.15 | | 0.37 | |
| 14 | | | | 0.20 | | | 0.38 | |
| 15 | | | | | | | 0.37 | |
| 16 | 0.005 | 0.0003 | | 0.28 | 0.19 | | 0.39 | |
| 17 | 0.005 | 0.0002 | | | | | 0.38 | |
| 18 | 0.006 | 0.0003 | | | 0.05 | | 0.42 | COMPARATIVE |
| 19 | 0.004 | 0.0002 | | | 0.20 | | 0.36 | EXAMPLE |
| 20 | | | | 0.10 | | | 0.36 | |
| 21 | | | | | | | 0.48 | |
| 22 | | | | | | | 0.37 | |
| 23 | 0.007 | 0.0003 | | | | | 0.42 | |
| 24 | | | | | | | 0.39 | |
| 25 | | | | | | | 0.37 | |
| 26 | | 0.0004 | | 0.12 | 0.12 | | 0.52 | |
| 27 | | | | | | | 0.30 | |
| 28 | 0.015 | | | | | | 0.45 | |
| 29 | | 0.0008 | | | | | 0.42 | |
| 30 | | | | 0.22 | | | 0.40 | STEEL OF INVENTION |

BLANK CELLS INDICATE THAT ELEMENTS ARE INTENTIONALLY NOT ADDED
UNDERLINES INDICATE THAT VALUES FALL OUTSIDE THE RANGE OF THE PRESENT INVENTION.

Figure 2:
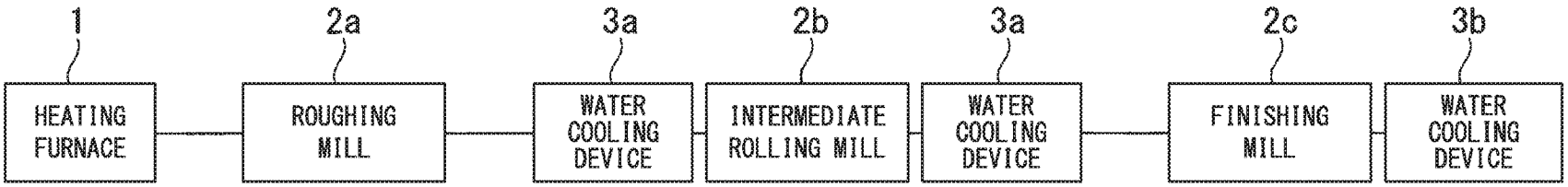
FIG. 2 is a diagram illustrating an example of a series of production apparatuses for an H-section steel according to an embodiment.

The production process of the H-section steel will be described using an example of a series of production apparatuses illustrated in FIG. 2. The steel pieces heated using a heating furnace 1 were rolled with a roughing mill 2*a*, and thereafter subjected to intermediate rolling with an intermediate rolling mill 2*b* including a series of universal rolling apparatuses and to finish rolling with a finishing mill 2*c*. After finish rolling was finished, the surfaces on the external side of the flange were water-cooled with a cooling device (water cooling device) 3*b* provided on the rear surface. In a case where interpass water cooling rolling was employed as the hot rolling, as water cooling between rolling passes, spray cooling of the surfaces on the external side of the flange using water cooling devices 3*a* provided on front and rear surfaces of the intermediate rolling mill 2*b* and reverse rolling were performed.

The production conditions are shown in Table 2.

TABLE 2

| PRODUCTION NO. | COMPONENT NO. | AMOUNT OF OXYGEN BEFORE TI ADDITION [mass %] | FLANGE THICKNESS [mm] | HEATING TEMPERATURE [° C.] | FINISH ROLLING TEMPERATURE [° C.] | RECUPERATED TEMPERATURE [° C.] |
|---|---|---|---|---|---|---|
| 1 | 1 | 0.0031 | 140 | 1330 | 900 | 600 |
| 2 | 2 | 0.0032 | 140 | 1330 | 900 | 620 |
| 3 | 3 | 0.0080 | 140 | 1330 | 900 | 600 |
| 4 | 4 | 0.0042 | 140 | 1330 | 900 | 580 |
| 5 | 5 | 0.0039 | 125 | 1300 | 880 | 620 |
| 6 | 6 | 0.0070 | 125 | 1300 | 880 | 620 |
| 7 | 7 | 0.0025 | 125 | 1300 | 880 | 600 |

TABLE 2-continued

| PRODUCTION NO. | COMPONENT NO. | AMOUNT OF OXYGEN BEFORE TI ADDITION [mass %] | FLANGE THICKNESS [mm] | HEATING TEMPERATURE [° C.] | FINISH ROLLING TEMPERATURE [° C.] | RECUPERATED TEMPERATURE [° C.] |
|---|---|---|---|---|---|---|
| 8 | 7 | 0.0029 | 125 | 1300 | 720 | 600 |
| 9 | 7 | 0.0021 | 125 | 1300 | 880 | 220 |
| 10 | 7 | 0.0019 | 125 | 1300 | 880 | 740 |
| 11 | 8 | 0.0018 | 100 | 1200 | 820 | 350 |
| 12 | 9 | 0.0055 | 100 | 1200 | 820 | 330 |
| 13 | 10 | 0.0025 | 100 | 1200 | 850 | 370 |
| 14 | 11 | 0.0028 | 100 | 1200 | 850 | 350 |
| 15 | 12 | 0.0020 | 140 | 1300 | 950 | 450 |
| 16 | 13 | 0.0016 | 140 | 1300 | 950 | 440 |
| 17 | 14 | 0.0021 | 125 | 1300 | 880 | 600 |
| 18 | 15 | 0.0036 | 125 | 1300 | 880 | 580 |
| 19 | 15 | 0.0035 | 125 | 1300 | 730 | 600 |
| 20 | 15 | 0.0028 | 125 | 1300 | 880 | 210 |
| 21 | 15 | 00036 | 125 | 1300 | 880 | 720 |
| 22 | 16 | 0.0030 | 100 | 1200 | 900 | 500 |
| 23 | 17 | 0.0031 | 100 | 1200 | 900 | 520 |
| 24 | 18 | 0.0027 | 125 | 1300 | 900 | 600 |
| 25 | 19 | 0.0022 | 125 | 1300 | 900 | 610 |
| 26 | 20 | 0.0023 | 125 | 1300 | 900 | 620 |
| 27 | 21 | 0.0028 | 125 | 1300 | 900 | 600 |
| 28 | 22 | 0.0031 | 125 | 1300 | 900 | 580 |
| 29 | 23 | 0.0029 | 125 | 1300 | 900 | 600 |
| 30 | 24 | 0.0039 | 125 | 1300 | 900 | 600 |
| 31 | 25 | 0.0002 | 125 | 1300 | 900 | 590 |
| 32 | 26 | 0.0033 | 125 | 1300 | 900 | 600 |
| 33 | 27 | 0.0036 | 125 | 1300 | 900 | 590 |
| 34 | 28 | 0.0040 | 125 | 1300 | 900 | 590 |
| 35 | 29 | 0.0038 | 125 | 1300 | 900 | 550 |
| 36 | 30 | 0.0104 | 125 | 1300 | 900 | 560 |

UNDERLINES INDICATE THAT VALUES FALL OUTSIDE THE RANGE OF THE PRESENT INVENTION.

A tensile test piece and a sample to be used for measurement of the area fraction of bainite were taken from the strength evaluation portion 7 shown in FIG. 1 in the obtained H-section steel. Using the acquired tensile test piece, the yield strength and the tensile strength were evaluated, and using the sample for measurement of the area fraction, the area fraction of bainite was measured.

In addition, a Charpy test piece, a sample to be used for measurement of the austenite grain size, and a sample for observing Ti oxides with a transmission electron microscope (TEM) were taken from the toughness evaluation portion 8 shown in FIG. 1 in the obtained H-section steel. The toughness was evaluated using the acquired Charpy test piece, the austenite grain size was measured using the sample for measurement of the grain size, and TEM observation was performed using the sample for observation. $t_1$ represents a web thickness, $t_2$ represents a flange thickness, F represents a flange length, and H represents a height.

The tensile test was conducted according to JIS Z 2241. When a sample showed yielding behavior, the yield point was obtained as YS. When the sample did not show yielding behavior, the 0.2% proof stress was obtained as YS. The Charpy impact test was conducted at a test temperature of 21° C. according to JIS Z 2242.

The results are shown in Table 3 (subsequent to Table 2). The target values of the mechanical properties of the present invention are set as follows: the yield strength or 0.2% proof stress (YS) at normal temperatures is set to 450 MPa or more; and the tensile strength (TS) at normal temperatures is set to 550 MPa or more. Further, the absorbed energy obtained by conducting the Charpy impact test at a test temperature of 21° C., that is, the Charpy absorbed energy (vE21) at 21° C. is set to 100 J or more.

TABLE 3

| | STRENGTH EVALUATION PORTION | | | TOUGHNESS EVALUATION PORTION | | | |
|---|---|---|---|---|---|---|---|
| PRODUCTION NO. | AREA FRACTION OF BAINITE [%] | YS [MPa] | TS [MPa] | AUSTENITE GRAIN SIZE [μm] | TI OXIDE DENSITY [PIECES/mm$^2$] | vE21° C. [J] | REMARKS |
| 1 | 93 | 470 | 643 | 190 | 150 | 215 | INVENTION |
| 2 | 85 | 480 | 651 | 163 | 220 | 167 | INVENTION |
| 3 | 85 | 474 | 614 | 154 | 249 | 202 | INVENTION |
| 4 | 92 | 490 | 650 | 145 | 358 | 181 | INVENTION |
| 5 | 90 | 459 | 627 | 174 | 95 | 186 | INVENTION |
| 6 | 88 | 467 | 612 | 190 | 318 | 160 | INVENTION |
| 7 | 90 | 472 | 619 | 188 | 109 | 161 | INVENTION |
| 8 | 59 | 413 | 572 | 139 | 90 | 218 | COMPARATIVE EXAMPLE |
| 9 | 90 | 481 | 634 | 166 | 74 | 50 | COMPARATIVE EXAMPLE |

TABLE 3-continued

| PRODUCTION NO. | STRENGTH EVALUATION PORTION: AREA FRACTION OF BAINITE [%] | YS [MPa] | TS [MPa] | TOUGHNESS EVALUATION PORTION: AUSTENITE GRAIN SIZE [μm] | TI OXIDE DENSITY [PIECES/mm$^2$] | vE21° C. [J] | REMARKS |
|---|---|---|---|---|---|---|---|
| 10 | 70 | 409 | 549 | 162 | 50 | 175 | COMPARATIVE EXAMPLE |
| 11 | 94 | 478 | 645 | 192 | 99 | 220 | INVENTION |
| 12 | 85 | 477 | 619 | 183 | 140 | 175 | INVENTION |
| 13 | 92 | 485 | 660 | 152 | 55 | 172 | INVENTION |
| 14 | 87 | 490 | 670 | 184 | 111 | 218 | INVENTION |
| 15 | 85 | 476 | 654 | 183 | 332 | 162 | INVENTION |
| 16 | 93 | 483 | 651 | 167 | 99 | 160 | INVENTION |
| 17 | 94 | 499 | 670 | 145 | 126 | 189 | INVENTION |
| 18 | 91 | 478 | 648 | 178 | 359 | 178 | INVENTION |
| 19 | 64 | 430 | 548 | 131 | 66 | 198 | COMPARATIVE EXAMPLE |
| 20 | 92 | 484 | 627 | 158 | 120 | 77 | COMPARATIVE EXAMPLE |
| 21 | 70 | 414 | 537 | 154 | 131 | 218 | COMPARATIVE EXAMPLE |
| 22 | 84 | 468 | 625 | 170 | 70 | 196 | INVENTION |
| 23 | 85 | 491 | 636 | 182 | 264 | 218 | INVENTION |
| 24 | 88 | 483 | 640 | 146 | 220 | 82 | COMPARATIVE EXAMPLE |
| 25 | 87 | 420 | 548 | 155 | 37 | 70 | COMPARATIVE EXAMPLE |
| 26 | 83 | 483 | 624 | 168 | 210 | 44 | COMPARATIVE EXAMPLE |
| 27 | 93 | 495 | 663 | 176 | 65 | 60 | COMPARATIVE EXAMPLE |
| 28 | 95 | 472 | 645 | 164 | 31 | 90 | COMPARATIVE EXAMPLE |
| 29 | 93 | 461 | 595 | 251 | 4 | 83 | COMPARATIVE EXAMPLE |
| 30 | 84 | 459 | 625 | 169 | 298 | 33 | COMPARATIVE EXAMPLE |
| 31 | 89 | 488 | 639 | 270 | 3 | 91 | COMPARATIVE EXAMPLE |
| 32 | 98 | 530 | 720 | 178 | 358 | 61 | COMPARATIVE EXAMPLE |
| 33 | 70 | 403 | 555 | 173 | 276 | 187 | COMPARATIVE EXAMPLE |
| 34 | 90 | 497 | 658 | 170 | 270 | 75 | COMPARATIVE EXAMPLE |
| 35 | 78 | 430 | 564 | 165 | 302 | 203 | COMPARATIVE EXAMPLE |
| 36 | 85 | 466 | 570 | 180 | 159 | 31 | COMPARATIVE EXAMPLE |

UNDERLINES INDICATE THAT VALUES FALL OUTSIDE THE RANGE OF THE PRESENT INVENTION.

Production Nos. 1 to 7, Production Nos. 11 to 18, and Production Nos. 22 and 23 in Table 3 are Invention Examples and the strength and toughness satisfy the target values. On the other hand, in Production Nos. 8 and 19, the finish temperature is low and the strength is low. In Production Nos. 9 and 20, the reheating temperature is low, MA is not sufficiently decomposed, and the toughness is low. In Production Nos. 10 and 21, the reheating temperature is high, bainite is not sufficiently formed, and the strength is insufficient.

The C content is large in Production No. 24 (Component No. 18), the Si content is large in Production No. 26 (Component No. 20), and the Mn content is large in Production No. 27 (Component No. 21), and the toughness is deteriorated. Contrarily, the C content is small in Production No. 25 (Component No. 19) and the carbon equivalent $C_{eq}$ is low in Production No. 33 (Component No. 27), and thus, the strength is not sufficient. Further, in Production No. 32 (Component No. 26), the carbon equivalent $C_{eq}$ is high, and the strength is increased and the toughness is deteriorated.

In Production No. 28 (Component No. 22), the Ni content is small and the toughness is deteriorated. In Production No. 29 (Component No. 23), the Al content is excessive. In Production No. 31 (Component No. 25), the amount of oxygen before the addition of Ti is insufficient, the amount of the formed Ti oxides is small, and the toughness is deteriorated. In Production No. 30 (Component No. 24), the Ti content is excessive, and the toughness is deteriorated. In Production No. 34 (Component No. 28), the Nb content is excessive, and the toughness is deteriorated.

In Production No. 35 (Component No. 29), the B content is excessive, and the strength is low. In Production No. 36 (Component No. 30), the amount of oxygen before the addition of Ti is excessive, and the toughness is deteriorated.

INDUSTRIAL APPLICABILITY

The high strength ultra thick H-section steel according to the present invention can be produced without adding a large amount of alloys or reducing carbon to the ultra low carbon level, which causes significant steel-making loads. Accordingly, this makes it possible to reduce production costs and shorten production time, thereby achieving a significant reduction in costs. Therefore, the reliability of large buildings can be improved without sacrificing cost efficiency, and hence, the present invention makes an extremely significant contribution to industries.

BRIEF DESCRIPTION OF THE REFERENCE SYMBOLS

1: HEATING FURNACE
2*a*: ROUGHING MILL
2*b*: INTERMEDIATE ROLLING MILL
2*c*: FINISHING MILL
3*a*: WATER COOLING DEVICES ON FRONT AND REAR SURFACES OF INTERMEDIATE ROLLING MILL
3*b*: COOLING DEVICE ON REAR SURFACE OF FINISHING MILL
4: H-SECTION STEEL
5: FLANGE
6: WEB
7: STRENGTH EVALUATION PORTION
8: TOUGHNESS EVALUATION PORTION
F: ENTIRE FLANGE LENGTH
H: HEIGHT
$t_1$: WEB THICKNESS
$t_2$: FLANGE THICKNESS

The invention claimed is:

1. An H-section steel comprising, by mass %:
C: 0.05% to 0.16%;
Si: 0.01% to 0.50%;
Mn: 0.80% to 2.00%;
Ni: 0.05% to 0.50%;
V: 0.01% to 0.20%;
Ti: 0.005% to 0.030%;
N: 0.0010% to 0.0100%;
O: 0.0005% to 0.0100%;
Cr: 0% to 0.50%;
Cu: 0% to 0.30%;
Mo: 0% to 0.30%;
W: 0% to 0.50%;
Al: limited to 0.005% or less;
Nb: limited to 0.010% or less;
B: limited to 0.0005% or less; and
a remainder including of Fe and impurities,
wherein a carbon equivalent $C_{eq}$ obtained by the following Equation 1 is 0.35% to 0.50%,
a density of Ti oxides having a grain size of 0.01 μm to 3.0 μm is 30 pieces/mm$^2$ or more,
a thickness of a flange is 100 mm to 150 mm,
at a ⅙ position from a surface of the flange in a length direction and at a ¼ position from the surface thereof in a thickness direction, an area fraction of bainite is 80% or more, a yield strength or 0.2% proof stress is 450 MPa or more, and a tensile strength is 550 MPa or more, and
at a ½ position from the surface of the flange in the length direction and at a ¾ position from the surface thereof in the thickness direction, a Charpy absorbed energy at 21° C. is 100 J or more, and an average austenite grain size is 50 μm to 200 μm, $$C_{eq}=C+Mn/6+(Cr+Mo+V)/5+(Ni+Cu)/15 \quad \text{Equation 1}$$

here, C, Mn, Cr, Mo, V, Ni, and Cu represent the amount % of each element and the amount of an element not contained is 0%.

2. The H-section steel according to claim 1, comprising, by mass %,
one of or two or more of
Cr: 0.01% to 0.50%,
Cu: 0.01% to 0.30%,
Mo: 0.001% to 0.30%, and
W: 0.01% to 0.50%.

3. The H-section steel according to claim 1, comprising, by mass %,
Mo: 0.001% to 0.29%.

4. The H-section steel according to claim 1, comprising, by mass %,
Mo: 0.001% to 0.20%.

5. A method of producing the H-section steel according to claim 1, the method comprising:
a refining process of deoxidizing a molten steel to allow a concentration of oxygen in the molten steel to be 0.0005% to 0.0100%, then adding Ti, and adjusting components of the molten steel to include by mass %, C: 0.05% to 0.16%, Si: 0.01% to 0.50%, Mn: 0.80% to 2.00%, Ni: 0.05% to 0.50%, V: 0.01% to 0.20%, Ti: 0.005% to 0.030%, N: 0.0010% to 0.0100%, O: 0.0005% to 0.0100%, Cr: 0% to 0.50%, Cu: 0% to 0.30%, Mo: 0% to 0.30%, W: 0% to 0.50%; Al: limited to 0.005% or less, Nb: limited to 0.010% or less, B: limited to 0.0005% or less, and a remainder including of Fe and impurities, and to have a carbon equivalent $C_{eq}$ obtained by the following Equation 2 of 0.35% to 0.50%;
a casting process of casting the molten steel to obtain a steel piece;
a heating process of heating the steel piece to 1100° C. to 1350° C.;
a hot rolling process of performing hot rolling on the heated steel piece so that a surface temperature of the steel piece is 800° C. or higher, thereby obtaining an H-section steel; and
a cooling process of water-cooling the H-section steel after the hot rolling process,
wherein in the cooling process, water cooling conditions are controlled so that the cooled surface temperature bounce back to within a temperature range of 300° C. to 700° C. after heat-recuperation, $$C_{eq}=C+Mn/6+(Cr+Mo+V)/5+(Ni+Cu)/15 \quad \text{Equation 2.}$$

6. The method of producing the H-section steel according to claim 5,
wherein the components of the molten steel include, by mass %,
one of or two or more of
Cr: 0.01% to 0.50%,
Cu: 0.01% to 0.30%,
Mo: 0.001% to 0.30%, and
W: 0.01% to 0.50%.

7. A method of producing the H-section steel according to claim 2, the method comprising:
a refining process of deoxidizing a molten steel to allow a concentration of oxygen in the molten steel to be 0.0005% to 0.0100%, then adding Ti, and adjusting components of the molten steel to include by mass %, C: 0.05% to 0.16%, Si: 0.01% to 0.50%, Mn: 0.80% to 2.00%, Ni: 0.05% to 0.50%, V: 0.01% to 0.20%, Ti: 0.005% to 0.030%, N: 0.0010% to 0.0100%, O: 0.0005% to 0.0100%, Al: limited to 0.005% or less, Nb: limited to 0.010% or less, B: limited to 0.0005% or less, and one or more of Cr: 0.01% to 0.50%, Cu: 0.01% to 0.30%, Mo: 0.001% to 0.30%, W: 0.01% to 0.50% and a remainder including of Fe and impurities, and to have a carbon equivalent $C_{eq}$ obtained by the following Equation 2 of 0.35% to 0.50%;

a casting process of casting the molten steel to obtain a steel piece;

a heating process of heating the steel piece to 1100° C. to 1350° C.;

a hot rolling process of performing hot rolling on the heated steel piece so that a surface temperature of the steel piece is 800° C. or higher, thereby obtaining an H-section steel; and a cooling process of water-cooling the H-section steel after the hot rolling process, wherein in the cooling process, water cooling conditions are controlled so that the cooled surface temperature bounce back to within a temperature range of 300° C. to 700° C. after heat-recuperation, $$C_{eq}=C+Mn/6+(Cr+Mo+V)/5+(Ni+Cu)/15 \quad \text{Equation 2.}$$

* * * * *